United States Patent [19]

Novello et al.

[11] 4,239,015

[45] Dec. 16, 1980

[54] DEVICE FOR PAINTING, SPRAYING, ENAMELLING OR TINTING OF MANUFACTURED ARTICLES IN GENERAL

[75] Inventors: Dante Novello, Manzano; Alessandro Mengotti, Cormons, both of Italy

[73] Assignee: Mil S.p.A., Buttrio, Italy

[21] Appl. No.: 880,023

[22] Filed: Feb. 21, 1978

[51] Int. Cl.[3] ..... B05C 5/00; B05B 5/02

[52] U.S. Cl. ..... 418/321; 118/322; 118/631

[58] Field of Search ..... 118/321, 322, 323, 324, 118/500, 630, 631; 239/186, 187

[56] References Cited

U.S. PATENT DOCUMENTS

| | | | |
|---|---|---|---|
| 2,397,482 | 4/1946 | Griffin | 118/323 |
| 2,926,627 | 3/1960 | Demorest et al. | 118/321 X |
| 3,008,648 | 11/1961 | Brady, Jr. et al. | 118/323 X |
| 3,570,451 | 3/1971 | Le Heron et al. | 118/500 X |
| 3,865,525 | 2/1975 | Dunn | 118/321 X |
| 4,129,092 | 12/1978 | Wiggins | 118/323 |

*Primary Examiner*—John P. McIntosh

*Attorney, Agent, or Firm*—Blanchard, Flynn, Thiel, Boutell & Tanis

[57] ABSTRACT

A device for painting, spraying, enamelling or tinting of manufactured articles in general, and for chairs in particular, includes a carriage supported for vertical movement by guides and having a pantograph arrangement for orbiting a spraying element with respect to the carriage. A support for the manufactured article is disposed in front of the spraying element and is arranged for rotating the manufactured article about a substantially vertical axis, such that spraying of the article can take place as the spraying element moves vertically and orbits and the manufactured article rotates.

9 Claims, 8 Drawing Figures

DEVICE FOR PAINTING, SPRAYING, ENAMELLING OR TINTING OF MANUFACTURED ARTICLES IN GENERAL

The object of the invention is a device suitable for use in automatic and semiautomatic painting, spraying, enamelling or tinting of manufactured products in general and favourably of chairs.

To be specific the invention relates to a painting device or a tinting device in which a sequence of operations are executed in an automatic manner.

More precisely the invention refers to a device in which the means of spraying are moved vertically and at the same time rotated, or more specifically orbited, about an axis substantially normal to the vertical movement, while the manufactured article to be painted, placed in front of the spraying means, is rotated about an axis substantially vertical.

According to the invention, the holder device of the article to be painted is advantageously adjusted in such a way as to position the center of inertia of the article in line with the vertical axis of rotation.

There are various known automatic and semiautomatic painting devices for chairs and similar articles and there are numerous drawbacks and disadvantages present therein.

One of the drawbacks is the fact that in said devices the articles to be painted are not rotated themselves but it is the spray pistol that is rotated about the chair; this results in a non-uniform distribution of the paint.

Another drawback is the fact that the spraying direction being substantially fixed it is not possible to obtain a uniform coat in the cavities present in chairs and other articles.

This phenomenon is particularly accentuated when electrical charge atomized paint is used.

In fact due to the known phenomenon called the "Faraday cage", the paint particles do not manage to enter in cavities unless they have a particular direction and velocity since the coulomb electrostatic forces are predominant.

Various attempts have been made to solve the problem but without appreciable success; thus the pressure of the atomized air was increased for example, or the electric charge was increased, or even the number of spray pistols was multiplied, etc.

Only partial solutions of the problems were obtained but with a considerable increase in waste and resulting in complex, expensive machines which were also difficult to maintain and to put in phase.

The principal aim of the present invention thus is the realization of a device for painting, enamelling, tinting or spraying of manufactured articles in general and for chairs in particular; that functions in an automatic or semiautomatic way and is capable of coordinating the movements of the spraying element, with the rotation of the article to be painted in such a way as to overcome the problems partially emphasized hereinabove.

One second aim of the present invention is to furnish the spraying element with appropriate alternate and rotational movements in order to exploit the inertial power accumulated by the atomized paint so as to facilitate its penetration, by its own force, into the internal cavities of the article to be painted.

One subsequent objective is to make up for the variation in the electric charge, in the thrust power of the atomizing air and the density of the paint or lac or varnish used, which is done by supplying the spraying element with alternate and rotational movements and imparting a rotational movement to the article to be painted.

One further objective is to provide for the adjustment of the holding support for the article in such a way as to align its center of inertia with the axis of rotation.

The invention presents various advantages such as saving in the quantity of paint and energy used, absence of operator's intervention, uniformity of coating, automatization of operation sequence, etc. Said aims and advantages and others resulting from the following description are achieved by the present invention of a device for painting, spraying, enamelling and tinting of manufactured articles in general and of chairs in particular, characterized by the fact that it comprises in cooperation and coordination

- a group carrying a spraying element running vertically on guides, imparting to said spraying element a rotational movement which is adjustable in dimensions, intensity and direction
- means for supporting and moving the manufactured article to be painted, positioned frontally to the spraying element and which is adjustable
  the movement of the spraying element and the movement of article to be painted being reciprocally coordinated and programmable and each is subordinated to the other.

In the description we will use the terms pistol, spray pistol or spraying element to indicate all the known means used in this field for spraying, painting, enamelling and tinting, whether these means are atomized with air, without air, with or without the possibility of supplying electric charge to the lac, paint or varnish, etc.

In the following we present, in an exemplified and non-restrictive manner, the description of one preferential embodiment of the invention making reference to the attached drawings in which.

In these drawings, similar parts or parts with similar functions carry similar reference numerals.

Figure 1:
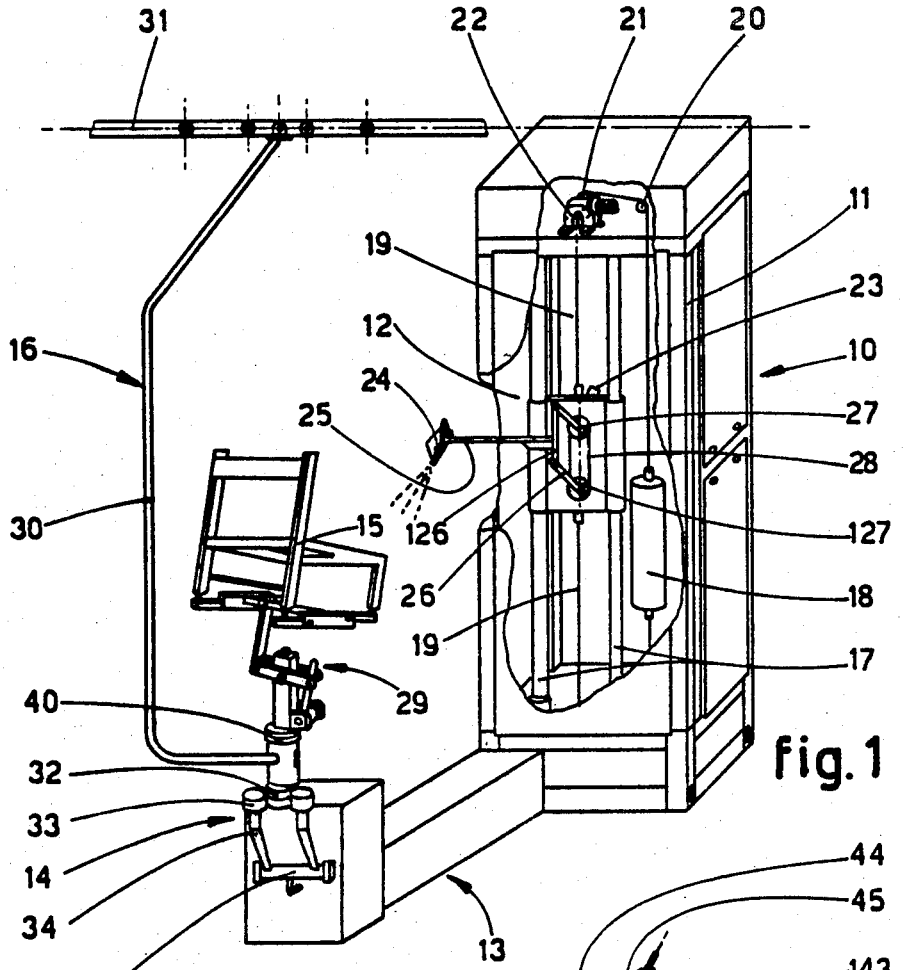
FIG. 1 illustrates schematically in an axonometric view the invention of the disclosure in action.
Figure 2:
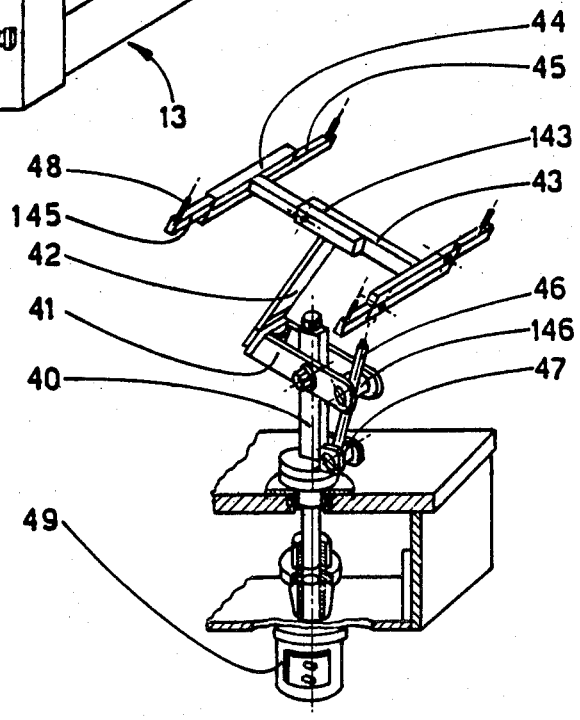
FIG. 2 illustrates in an axonometric view of the group supporting the article to be painted; in this case a chair.
Figure 3:
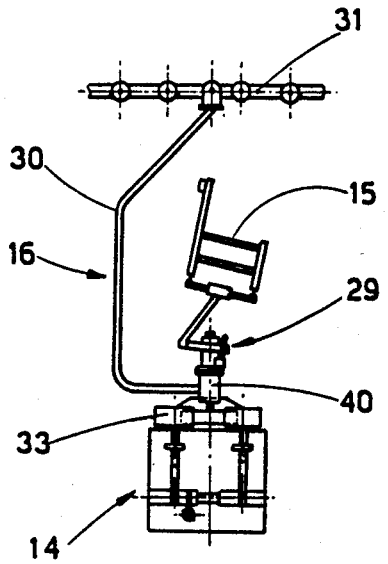
FIG. 3 illustrates, in a frontal view, some air means for supporting the articles to be painted.
Figure 8:
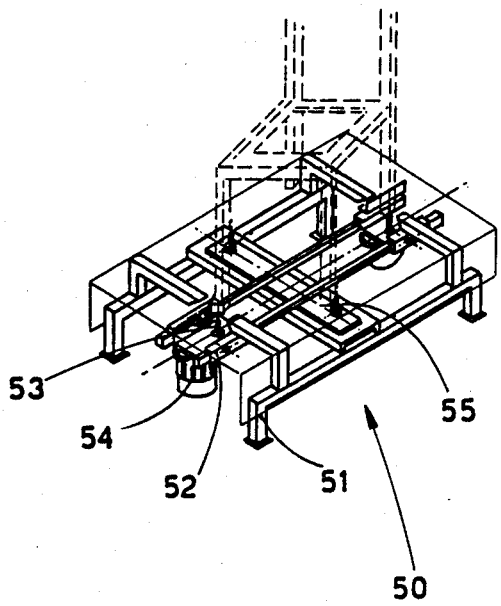
FIG. 8 illustrates a device for effecting the support holes.
Figure 4:
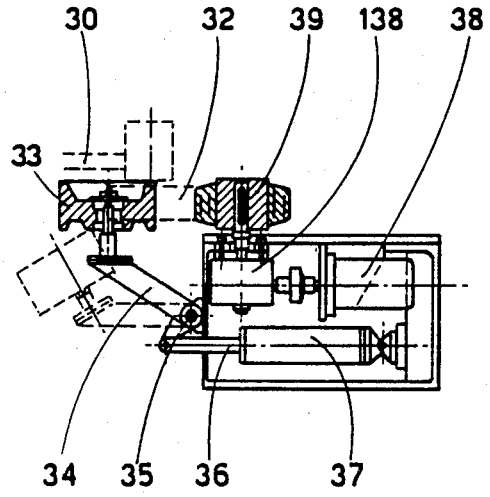
FIGS. 4 and 5 illustrate, in a section view and in plan view, a device for rotating the device of FIG. 3.
Figure 5:
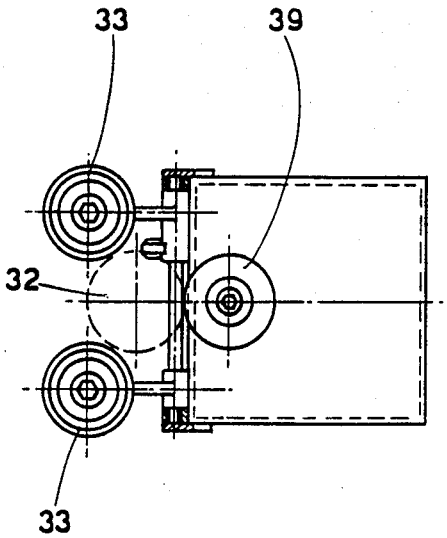

Thus with reference to FIG. 1 and the following we have: 10 is generically the painting device or painting machine constituted of a body 11 carrying the mobile pistol-supporting carriage 12 and one beam 13 carrying at its end some generic means 14 suitable for rotating the manufactured article 15, article 15 is a chair in the example, mounted on means of support and movement 16. Shown at 17 are the vertical guides on which runs the carriage 12, which guides may be single or multiple; 18 is the counterweight of the carriage 12; 19 is the chain or positive belt or similar that joins, in a closed ring, the carriage 12 and the counterweight 18; and 20 is the toothed wheel for the upper transmission. There are, at the bottom, two more transmission wheels 20 (non-illustrated) suitable for engaging the belts. Shown at 21 is the toothed wheel driving the belt; 22 is the motor-speed reducer controlling and driving the toothed wheel 21; 23 is the motor group positioned on the carriage 12; 24 is the pistol or spraying element; 25 is the arm supporting the pistol 24 and through which the motion is transmitted to said pistol; 26 are the rotating arms of the pantograph and 126 is the arm rotated by arm 26, the position of 126 being adjustable with respect to the center of rotation of arms 26, such that the pantograph imparts an independent rotational, or more precisely orbital, movement to the pistol; and 27 and 127 are the wheels that solidly carry over the arms 26. Said wheels 27 and 127 are peripherally joined by a chain or a positive belt 28 in a closed circuit which keeps them in phase. The wheel 27 receives its motion from motor group 23. Shown at 29 is generically the device for sustaining and positioning the article to be painted; 30 is the arm for sustaining and supporting sustained by a flying chain 31, said overhead chain conveyor can be part of a complex of painting, passivation, drying, etc. The overhead conveyor chain 31 may be substituted by a support having two or more rotating horizontal arms carrying at their extremities the support arm 30 that is to allow the operator to load and unload the articles while the device 10 provides for the painting of the article 15 thus avoiding wasted time.

Then we have: 32 is the pulley which receives rotation and transmits it to the support 29 of the article to be painted; 33 are the idle pulleys which keep the pulley 32 pressed against the driving pulley 39. Shown at 34 are the mobile arms for sustaining and positioning the idle pulleys 33; 35 is the common axis of the arms 34; 36 is the shaft of cylinder piston 37 which actuates the mobile arms 34. Shown at 38, 138 is the motor-reducer group which drives the wheel 39; 39 is the wheel that drives the pulley 32; 40 is the rotating body of support 29. Said rotating body is solid to the pulley 32 and positioned in rotation to it. Shown at 41 are some arms hinged at 40; 42 is a blade positionable as desired on connecting plate of arms 41; 43-143 are the upper guides solid to the blade 42; 44 are T-shaped elements fixible at will to the upper guides 43-143; 45-145 are elements sliding in the T-shaped guides, and carrying at their ends the anchorage pins 48. Shown at 46 is a screw cooperating with lump 146 oscillating between blades 41; 47 is the oscillating lump holding screw 46 but allowing it to rotate; 49 is a motor to be used as a substitute for the group 38-138 when support 29 is not mounted on the arms 16 but instead is placed in an autonomous way in the terminal part of beam 13. In the latter case, the operator must await the painting machine 10 to complete its work cycle before being able to substitute the article 15.

Figure 7:
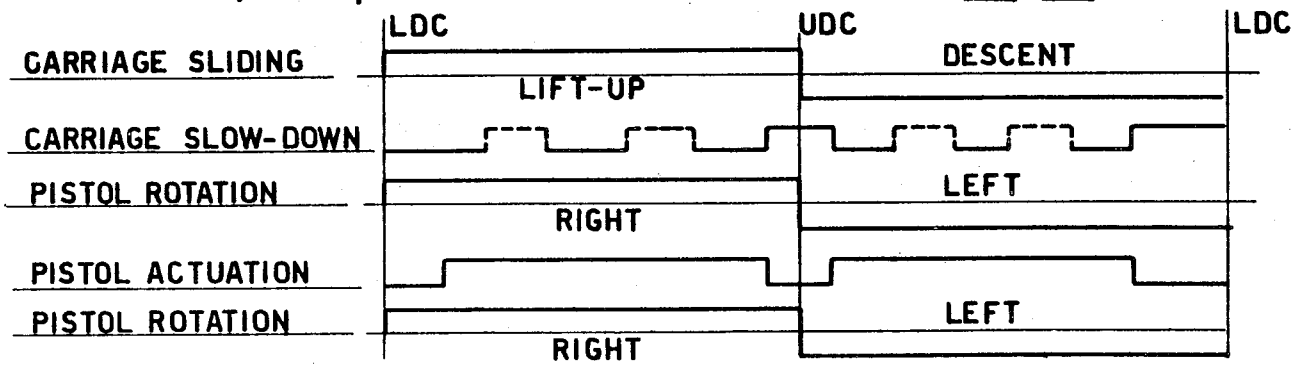
FIG. 7 illustrates one possible sequence of phases.

Then we have: 50 is generically the device for prepositioning the chairs by their foot-holes, i.e. the holes in which are entered pins 48; 51 is the support frame; 52 are adjustable slides which carry piercing members 53 actuated by motor means 54; 55 are the jacks for raising the slides 52 allowing thus the members 53 to pierce axially the bottom of chair leg or the rest point of other manufactured articles. Turning to FIG. 7, 56 are the pumps of the control hydraulic circuit, which can be single or multiple; 57 is the motor driving the pumps; 58 is the hydraulic motor for the lifting up and lowering group 22; 59 is the hydraulic motor of group 23 driving wheels 27; 60 represents either the motor 38 or 49; 61-161-261 are control electrovalves which determine the direction of rotation of the hydraulic motors 58, 59 and 60; 62-162-262 are service electrovalves.

As mentioned, instead of chain 31 a support with arms can be used.

In place of device 29 mounted on arms 30, there could be a device 29 mounted terminally and possibly to the beam 13.

There could also be a chain which mount the devices 29 or similar which will be put in rotation by mechanical means similar or assimilable to those of FIGS. 1–4 and 5. Let us see how the whole functions.

The manufactured article 15, in this example a chair, is placed on the device 50 to which then are applied two or more axial holes in lower part of the legs. Said article is then positioned on device 29, care is taken that the pins 48 enter in the axially made holes in the lower part of the leg of the chair.

Doing so, we have achieved maximum stability and safety in holding the chair without creating deposition points preferential to the paint or without covering part of the chair by the holding means which would stay void of paint.

The device 29 is adjusted in advance to suit each specific article and in the case of chairs the adjustment will tend to align the center of inertia of the chair with the axis of rotation of device 29.

Said adjustment is affected as follows:

- blade 42 is positioned in such a way so as to place the article at the right height with respect to the painting machine and the spraying pistol.
- the T-shaped elements 44 are positioned in the upper guides 43-143 so as to present the same depth of the support holes of the article, said T-shaped elements are then finally positioned to align the axis of rotation with the center of inertia of the article.
- the sliding elements 45-145 are so positioned that the pins 48 coincide with axes of the support holes of the article.
- the screw 46 is rotated to obtain the desired inclination.

Two situations can result after placing the article on 29. The first situation: the device 29 is positioned terminally and solidly to the beam 13 and the operator then must himself activate the repetition of the painting cycle to avoid long delay or too short substitution time. Second Situation: the device 29 is positioned on a mobile support (for example that of FIGS. 1 and 3 then the loading and unloading of the article are done simultaneously within the automatic painting cycle, the device 29 with the painted article is substituted by a device 29 with an article still to be painted in an advantageously autonomous way.

In this second situation, the end of the painting cycle conditions said substitution, while the coming substitution conditions the commencement of the painting cycle.

The painting cycle, whether activated by the operator or by the substitution of the article already painted by one to be painted proceeds as follows (FIG. 7): at the beginning of the cycle, motors 58-59-60 activate groups 22-23-38/138 or 49 respectively.

The motor 58 is actuated in one direction by the electrovalve 61. Once motor 58 is functioning, the carriage 12 starts to rise pulled by the chain 19 which is driven in turn by the toothed wheel 21.

The departure position (LDC) and that of the end of rise (UDC) can be determined by end of stroke positioners (not illustrated) cooperating, for example, with an activator positioned on carriage 12.

It is possible with these positioners to determine the starting point of rise (LDC) and the length of stroke.

The motor 59 is activated in the desired direction of rotation by the electrovalve 161.

The motor 59 actuates group 23 which drive the two wheels 27-127. Once the wheels 27-127 start rotating, the pistol 24 due to the presence of the rotating parallelogram 26-126, receives a rotary motion in the same plane or in a plane parallel to that in which the carriage 12 is rising. This involves the pistol 24 in a circular movement while rising or descending. Only the pistol 24 and part of arm 25 project out of the fairing of the painting machine.

The motor 60 is actuated in one direction of rotation by the electrovalve 261. The motor 60 (38 or 49) rotates the article about its axis of rotation. When the carriage 12 has reached the upper dead center (UDC), the most upper position it is allowed to travel by the positioners, all three of the motors 58-59 and 60 invert their direction due to the action of the respective electrovalves 61-161 and 261.

Along the rise or descent of the carriage 12 the lift velocity or descent velocity of said carriage 12 can be reduced as desired through the intervention of the electrovalve 62.

Figure 6:
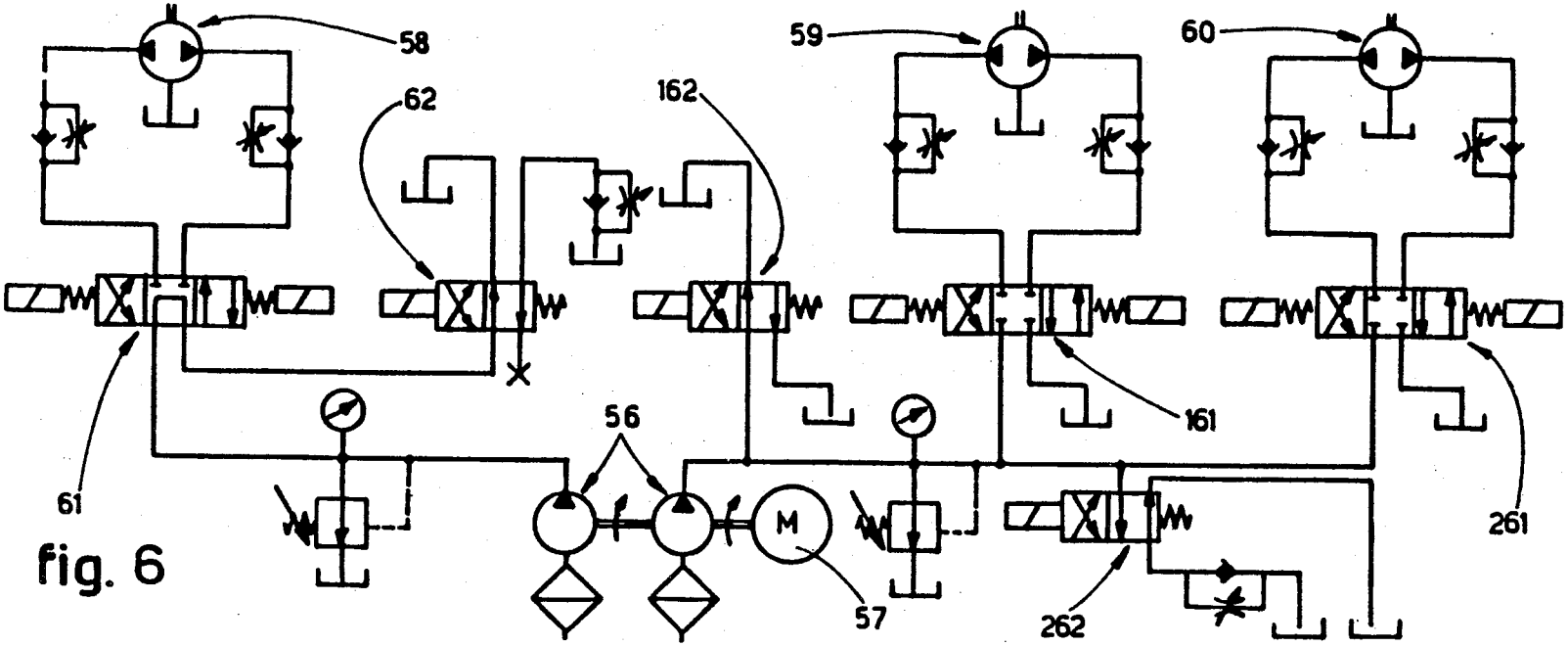
FIG. 6 illustrates a hydraulic circuit.

According the circuit of FIG. 6 it is also possible to reduce the velocity of motors 59 and 60 through the intervention of the electrovalves 162 and/or 262.

The actuation of the electrovalves 62-162-262 can come about either by the insertion on part of the carriage 12 during its travel, of opposite switches or microswitches placed at well along the travel of the carriage or by whichever other system known in the field, such as timers, control panels, programmable discs, etc.

The actuation of electrovalves 62-162 and 262 may come about one or more times as desired effecting, for example, the slowing down in function with particular positions of the article.

The actuation of electrovalves 62-162 and 262 can also be coordinated with a position circumferentor of the article so that the effect of slowing down is accentuated coming in as a function of certain position of the article. The actuation of the pistol, that is the issue of the paint, lac or varnish comes advantageously after a short delay with respect to the start of lift and descent while terminating before the end of lift (UDC) and before the return to the lower dead center (LDC).

The axis of issue of the painting element 24 can either be substantially passing through the axis of rotation of the article, or can be laterally spaced either fixed or in a way where it is able to move symmetrically or substantially symmetrically when the article engages the rotary motion. Here we have described one solution of the invention, although an expert in the art can deduce many variants without going beyond the ambit of the inventive idea presented therein; thus it is possible to vary proportions and dimensions; it is possible to provide for the suspension of articles to be painted instead of holding them from below; it is possible to substitute the device 29 with another having extendible arms; it is possible to provide the article with pins 48 already included therein; thus it is possible to replace the pair of wheels 27 and 127 and the rods 26 and 126 by a motor means with eccentric motion in which a connecting rod substitute the rod 25, said connecting rod can be provided by means suitable for keeping it aligned in parallel with the normal to the center line of the spray.

Thus it is possible to use instead of chain displacement means 31, rope means or suspended rotating means.

It is also possible to use instead of the curved bar 30 a hook formed of more rods with a recess or open cage.

It is also possible to substitute the chain 19 by a screw parallel to the guides, acting on a lead screw present in the carriage, or it is possible to replace the chain 19 by a motorized toothed wheel cooperating with a rack parallel to the guides.

It is further possible that all the friction wheels 33-39 can be motorized. These and other variants are all possible within the ambit of the inventive solution of the invention.

I claim:

1. Device for painting, spraying, enamelling or tinting of manufactured articles in general, and for chairs in particular, comprising in combination:

carrier means carrying a spraying element and guide means supporting said carrier means to run vertically thereon, the carrier means having means for imparting to said spraying element an orbital motion, said means for imparting including an arm supporting said spraying element and fixed on a rigid connecting element articulated to the extremities of two parallel arms, the arms being mounted on two wheels peripherally joined by a closed chain and mounted for rotation with respect to said carrier means, the axes of rotation of said wheels being parallel and at least one wheel being driven by a motor means;

means for holding and moving the manufactured article in front of the spraying element, said holding and moving means being adjustable.

2. The device of claim 1 in which said spraying element carrier means comprises a carriage vertically sliding on at least one guide defining said guide means, the lift and descent movement being adjustable and the upper and lower dead centers being adjustably positionable.

3. Device for painting, spraying, enamelling or tinting of manufactured articles in general, and for chairs in particular, comprising in combination:

carrier means carrying a spraying element and guide means supporting said carrier means to run vertically thereon, the carriage having means for imparting to said spraying element an orbital motion;

means for holding and moving the manufactured article in front of the spraying element, said article holding means including support means movable along a path past a spraying station at which said guide means is located, a positioning means supported for rotation on said support means and movable therewith along said path, said positioning means being arranged to support said manufactured article for rotation in front of said spraying element, motor means separate from said positioning means and fixedly located at said spraying station adjacent said spraying element guide means and having a rotatable drive member, said rotatable positioning means having a rotatable driven member engageable with said drive member when the support means moves the article and positioning means into said spraying station so as to impart rotation to said article to permit said spray gun to spray different sides thereof.

4. The apparatus of claim 3 in which said support means includes a conveyor line running through said spraying station and a member fixed to said conveyor line and carrying said positioning means, said motor means including a motor rotatably driving said drive member, said drive member being a rotatable wheel having an axis of rotation fixed with respect to said guide means, said driven member having an axis substantially parallel to that of said drive member and being a second wheel, said first and second wheels being exposed, having axes parallel to the axis of rotation of the said positioning means and article and having interengageable rim portions to directly effect driving of said driven member by said drive member by positioning of said support means in front of said motor means at said spray station, said motor means further including an idler member actuable for urging said drive and driven members into efficient rotative driving engagement.

5. The apparatus of claim 3 in which said positioning means includes a body rotatably supported on said support means for rotation about a first axis and having said rotatable driven member fixed thereto, arm means having an intermediate portion pivoted on said body for pivoting about a second axis substantially perpendicular to said first axis, a blade adjustably positionable on one end of said arm means and extending upward therefrom, guide means fixed to and extending transversely of said blade, substantially T-shaped members having legs supported by said guide means and extending in opposite directions therefrom, said T-shaped members having cross heads spaced from each other and of adjustable length, and anchorage means on said cross heads for securing said article thereto for spraying, and screw means connected between said body and the other end of said arm means for adjusting the inclination of said arm means about said second axis.

6. Device for painting, spraying, enamelling or tinting of manufactured articles in general, and for chairs in particular, comprising in combination:

carrier means and guide means supporting said carrier means to run vertically thereon, said carrier means including orbital motion means carrying said spraying element and actuable for imparting to said spraying element an orbital motion with respect to an axis on said carrier means wherein said spraying element maintains a substantially constant orientation with respect to said carrier means and guide means as it orbits, said orbital motion being adjustable as to the diameter of the orbit of said spray element wherein said orbital motion means includes means adjustable for varying the average distance of the orbiting spray element from said axis;

means for holding and rotating the manufactured article in front of the spraying element at a desired spraying distance, and including means for adjusting the orientation of said article with respect to the spraying element.

7. The device of claim 6, in which the orbital plane of said spraying element substantially faces toward said article holding means, said article holding and moving means including means supporting said article for rotation about an axis substantially parallel to said orbital plane;

said supporting means including means adjustable for aligning the axis of article rotation with the center of inertia of the article thereon, and a motor means actuable for rotating said article holding means about said axis substantially parallel to said orbital plane of said spraying element, with the latter axis at a location in front of said spraying element.

8. The apparatus of claim 6 including a carrier motor actuable for vertically moving said carrier means along said guide means, said orbital motion means including a motor actuable for orbiting said spraying element, said guide means being substantially parallel to the plane of orbital motion, so that said spray means moves orbitally and vertically in the same plane, said means for holding and moving the article including a further motor actuable for rotation of said article, said motors being reversible to permit simultaneous reversal thereof upon the carriage reaching the end of its vertical travel.

9. Device for painting, spraying, enamelling or tinting of manufactured articles in general, and for chairs in particular, comprising in combination:

carrier means and guide means supporting said carrier means to run vertically thereon, said carrier means including orbital motion means carrying said spraying element and actuable for imparting to said spraying element an orbital motion with respect to said carriage wherein said spraying element maintains a substantially constant orientation with respect to said carrier means and guide means as it orbits, said orbital motion being adjustable, said orbital motion means comprising an arm to which the spraying element is secured, said arm being fixed rigidly to a connecting element in turn articulated to the extremities of two parallel arms each fully rotatable on fixed centers on the carrier means for continuous orbiting of said spraying element, first-mentioned arm and connecting element;

means for holding and moving the manufactured article in front of the spraying element at a desired spraying distance and for adjusting the orientation of said article with respect to the spraying element.

* * * * *

UNITED STATES PATENT OFFICE

CERTIFICATE OF CORRECTION

Patent No. 4 239 015 Dated December 16, 1980

Inventor(s) Dante Novello and Alessandro Mengotti

It is certified that error appears in the above-identified patent and that said Letters Patent are hereby corrected as shown below:

In the heading information, insert the following:

---Foreign Application Priority Data

| | | |
|---|---|---|
| Feb. 21, 1977 | Italy | 83333 A/77 |
| Feb. 8, 1978 | Italy | 83324 A/78 ---. |

Signed and Sealed this

*Seventeenth* Day of *March 1981*

[SEAL]

*Attest:*

RENE D. TEGTMEYER

*Attesting Officer* *Acting Commissioner of Patents and Trademarks*